US008303072B2

(12) United States Patent
Shibata et al.

(10) Patent No.: US 8,303,072 B2
(45) Date of Patent: Nov. 6, 2012

(54) LIQUID SUPPLY APPARATUS AND IMAGE FORMING APPARATUS

(75) Inventors: Hiroshi Shibata, Kanagawa-ken (JP); Tetsuzo Kadomatsu, Kanagawa-ken (JP)

(73) Assignee: FUJIFILM Corporation, Tokyo (JP)

( * ) Notice: Subject to any disclaimer, the term of this patent is extended or adjusted under 35 U.S.C. 154(b) by 133 days.

(21) Appl. No.: 12/892,501

(22) Filed: Sep. 28, 2010

(65) Prior Publication Data

US 2011/0074841 A1 Mar. 31, 2011

(30) Foreign Application Priority Data

Sep. 29, 2009 (JP) ..... 2009-225041

(51) Int. Cl.
*B41J 29/377* (2006.01)
*B41J 29/28* (2006.01)
*B41J 2/175* (2006.01)

(52) U.S. Cl. ..... 347/18; 347/6; 347/85

(58) Field of Classification Search ..... 347/6, 18, 347/85, 89

See application file for complete search history.

(56) References Cited

U.S. PATENT DOCUMENTS

| | | | | |
|---|---|---|---|---|
| 5,402,160 | A | 3/1995 | Kadowaki et al. | |
| 5,451,989 | A | 9/1995 | Kadowaki et al. | |
| 2002/0171724 | A1 | 11/2002 | Naniwa et al. | |
| 2005/0219282 | A1 | 10/2005 | Kachi | |
| 2006/0152541 | A1 * | 7/2006 | Isozaki et al. | 347/17 |
| 2007/0252860 | A1 | 11/2007 | Nitta et al. | |
| 2008/0007579 | A1 | 1/2008 | Furukawa et al. | |
| 2009/0015619 | A1 | 1/2009 | Chang et al. | |
| 2009/0179937 | A1 | 7/2009 | Yamada | |

FOREIGN PATENT DOCUMENTS

| | | | |
|---|---|---|---|
| JP | 3-104655 | A | 5/1991 |
| WO | WO 2006/075314 | A2 | 7/2006 |

OTHER PUBLICATIONS

Extended European Search Report for Application No. 10178773.7 dated Nov. 23, 2010.

* cited by examiner

*Primary Examiner* — Geoffrey Mruk

(74) *Attorney, Agent, or Firm* — Birch, Stewart, Kolasch & Birch, LLP.

(57) ABSTRACT

A liquid supply apparatus includes: a plurality of heat exchange devices which are respectively provided in a plurality of supply paths for supplying liquids to a plurality of liquid ejection heads respectively, are supplied with a liquid medium adjusted to a predetermined temperature from a liquid temperature adjusting device, and conduct heat exchange between the liquids flowing in the plurality of supply paths and the liquid medium supplied from the liquid temperature adjusting device; a plurality of flow rate adjusting devices which are respectively provided correspondingly to the plurality of heat exchange devices and adjust a flow rate of the liquid medium supplied to each of the plurality of heat exchange devices from the liquid temperature adjusting device; and a controller which controls each of the plurality of flow rate adjusting devices to individually change the flow rate of the liquid medium supplied from the liquid temperature adjusting device to the plurality of heat exchange devices.

13 Claims, 9 Drawing Sheets

LIQUID SUPPLY APPARATUS AND IMAGE FORMING APPARATUS

BACKGROUND OF THE INVENTION

1. Field of the Invention

The present invention relates to a liquid supply apparatus and an image forming apparatus, and more particularly to a technique for performing temperature control of a liquid supplied to a liquid ejection head.

2. Description of the Related Art

An inkjet recording apparatus is provided with a recording head (inkjet head) in which a plurality of nozzles are arranged in an ejection plane, and an image is formed on a recording medium by ejecting ink droplets from the nozzles, while the recording medium and the recording head are moved relative to each other. Examples of an ink ejection system of the recording head include a piezoelectric system in which the displacement of a piezoelectric element is used to pressurize the ink inside a pressure chamber and eject an ink droplet from the nozzle, and a thermal system in which thermal energy generated by a heat-generating element such as a heater is used to generate a gas bubble inside a pressure chamber and eject an ink droplet from the nozzle by the generated pressure.

Such inkjet recording apparatuses can be of a serial system or a line system. The serial system is provided with a recording head in which nozzle rows are disposed along the conveyance direction of the recording medium and recording is performed by repeating intermittently the reciprocating movement of the recording head in the widthwise direction of the recording medium (direction perpendicular to the paper conveyance direction; main scanning direction) and conveyance of the recording medium. The line system is provided with a receding head in which nozzle rows are disposed along the widthwise direction of the recording medium and recording is performed by moving the recording medium in the paper conveyance direction (sub-scanning direction) with respect to the recording head. One of the benefits of the line system over the serial system is in that the recording speed can be increased, and the line system can be applied widely to various industrial fields.

An ink supply system (ink supply device) of the inkjet recording apparatus is provided with an ink tank accommodating ink to be supplied to the recording head. The ink tank and the recording head are linked by an ink supply path, and a pump serving as a liquid pumping device is installed in the ink supply path. The ink is supplied from the ink tank into the recording head via the ink supply path by driving the pump.

The viscosity of ink used in the inkjet recording apparatus changes according to temperature. Therefore, when the temperature of ink supplied to the recording head changes, the ink viscosity changes, thereby causing variations in ink ejection characteristics. For example, when the ink temperature decreases, the ink viscosity increases, causing reduction in the ejection amount or decrease in the flying velocity of the ink and creating density unevenness in the recorded image. Accordingly, inkjet recording apparatuses have been heretofore suggested that are provided with a temperature adjusting mechanism for adjusting the temperature of ink supplied to the recording head, with the object of stabilizing the ejection characteristic of the recording head (see, for example, Japanese Patent Application Publication No. 3-104655).

However, since the inkjet recording apparatus described in Japanese Patent Application Publication No. 3-104655 is provided with a temperature adjusting device for each ink color, the cost of the apparatus is raised. Further, since the total amount of droplets to be ejected onto the recording medium is determined, when a temperature adjusting device is provided for each color, the temperature adjustment capability corresponding to the maximum droplet ejection amount is necessary for each color and an excess capability as a whole is required, thereby raising the cost.

In particular, in an inkjet recording apparatus of a line system, increase in the recording speed and increase in quality of recorded images are required together with wide printing. Therefore, the amount of ink consumed by the recording head (ejection amount) is increased and the amount of generated heat also increases due to increase in a drive frequency. Further, since accuracy needed for ink temperature rises, a controllable temperature range of ink is narrowed.

Thus, a strong temperature adjustment capability is needed for the ink supplied to the recording head and a stringent requirement is also placed on control accuracy relating to ink temperature adjustment. The problem is that these requirements cannot be met by the temperature adjustment performed by air cooling, such as used in the inkjet recording apparatus described in Japanese Patent Application Publication No. 3-104655.

Using a water cooling system to adjust the temperature of ink supplied to the recording head can be also considered, but this approach could result in undesirable significant cost increase because the ink temperature is adjusted separately for each recording head.

SUMMARY OF THE INVENTION

The present invention has been conceived with the foregoing in view and it is an object of the present invention to provide a liquid supply apparatus and an image forming apparatus that can adjust the temperature of liquid supplied to a liquid ejection head and stabilize the ejection of the liquid ejection head, without increasing the cost significantly.

In order to attain an object described above, one aspect of the present invention is directed to a liquid supply apparatus comprising: a plurality of heat exchange devices which are respectively provided in a plurality of supply paths for supplying liquids to a plurality of liquid ejection heads respectively, are supplied with a liquid medium adjusted to a predetermined temperature from a liquid temperature adjusting device, and conduct heat exchange between the liquids flowing in the plurality of supply paths and the liquid medium supplied from the liquid temperature adjusting device; a plurality of flow rate adjusting devices which are respectively provided correspondingly to the plurality of heat exchange devices and adjust a flow rate of the liquid medium supplied to each of the plurality of heat exchange devices from the liquid temperature adjusting device; and a controller which controls each of the plurality of flow rate adjusting devices to individually change the flow rate of the liquid medium supplied from the liquid temperature adjusting device to the plurality of heat exchange devices.

According to this aspect of the invention, by controlling each of the flow rate control valves provided respectively between the liquid temperature adjusting device and the heat exchange units, the supplied amount of liquid medium that is supplied to each heat exchange unit can be individually changed and the heat exchange ratio of liquid (ink) and liquid medium in each heat exchange unit can be varied for each heat exchange unit. As a result, the temperature of liquid supplied to each liquid ejection head can be individually adjusted, ejection stability of each liquid ejection head can be stabilized, and inconveniences such as density unevenness caused by the difference in liquid temperature can be eliminated.

Further, since the temperature of liquid supplied to each liquid ejection head can be adjusted for each type of liquid (for example, for each color of liquid) only by changing the supplied amount of liquid medium supplied to each heat exchange unit, no excess temperature adjustment capability is required for each type of liquid and cost can be reduced.

Desirably, the plurality of flow rate adjusting devices are flow rate control valves; and the controller changes opening area of the flow rate control valves to change the flow rate of the liquid medium supplied from the liquid temperature adjusting device to the plurality of heat exchange devices.

According to this aspect of the invention, the flow rate of liquid medium supplied to each heat exchange unit can be finely adjusted for each heat exchange unit and the temperature of liquid supplied to each liquid ejection head can be optimized.

Desirably, each of the plurality of flow rate adjusting devices includes a plurality of parallel flow paths in parallel connected in an individual flow path of the liquid medium to the heat exchange device, and a plurality of electromagnetic valves respectively provided in the plurality of parallel flow paths; and the controller controls opening and closing of the plurality of electromagnetic valves to change the flow rate of the liquid medium supplied from the liquid temperature adjusting device to the plurality of heat exchange devices.

According to this aspect of the invention, the flow rate of liquid supplied to each heat exchange unit can be adjusted by controlling together the opening and closing of electromagnetic valves provided in each parallel flow path. Further, by using electromagnetic valves that are cheaper and easier to control than flow rate control valves, it is possible to reduce the cost of the liquid supply apparatus.

Desirably, part or all of the plurality of parallel flow paths have mutually different flow path resistances.

According to this aspect of the invention, the adjustment range of the flow rate of liquid supplied to each heat exchange unit can be broadened.

Desirably, all of the plurality of parallel flow paths have a same flow path resistance.

According to this aspect of the invention, since the flow rate of liquid supplied to a heat exchange units is proportional to the number of parallel flow paths in which electromagnetic valves are open, from among the plurality of parallel flow paths corresponding to the heat exchange unit, the flow rate control performed by the controller can be simplified.

Desirably, the liquid supply apparatus further comprises a plurality of liquid temperature measuring devices which measure temperature of the liquids supplied to the plurality of liquid ejection heads respectively, wherein the controller controls each of the plurality of flow rate adjusting devices according to the temperature of the liquids measured by the plurality of liquid temperature measuring devices.

According to this aspect of the invention, by adjusting the flow rate of liquid medium supplied to the heat exchange units correspondingly to the temperature of liquid inside the liquid ejection heads, it is possible to set the liquid inside the liquid ejection heads to desired temperature.

Desirably, the liquid supply apparatus further comprises a plurality of liquid flow rate measuring devices which measure flow rates of the liquids supplied to the plurality of liquid ejection heads respectively, wherein the controller controls each of the plurality of flow rate adjusting devices according to the flow rates of the liquids measured by the plurality of liquid flow rate measuring devices.

In this aspect of the invention, the liquid flow rate measuring devices may be flow rate sensors provided in supply paths for supplying the liquid to the liquid ejection heads, or may be revolution speed sensors that detect the revolution speed of pumps provided as liquid pumping devices in the supply paths.

Desirably, the liquid supply apparatus further comprises a head ejection ratio calculation device which calculates ejection ratios of the plurality of liquid ejection heads, wherein the controller controls the plurality of flow rate adjusting devices according to the ejection ratios of the plurality of liquid ejection heads calculated by the head ejection ratio calculation device.

In this aspect of the invention, the flow rate of liquid medium supplied to the heat exchange units is desirably adjusted according to the ejection ratios of the liquid ejection heads. There is a correlation between the ejection ratio of the liquid ejection head and the temperature of liquid inside thereof, and by adjusting the flow rate of liquid medium supplied to the heat exchange units on the basis of the ejection ratios of the liquid ejection heads, it is possible to set the liquid inside the liquid ejection heads to desired temperature.

Desirably, the controller controls each of the plurality of flow rate adjusting devices and also controls temperature of the liquid medium adjusted by the liquid temperature adjusting device.

According to this aspect of the invention, the temperature of liquid supplied to each liquid ejection head can be further optimized.

In order to attain an object described above, another aspect of the present invention is directed to an image forming apparatus comprising any one of the liquid supply apparatuses above.

According to the present invention, by controlling each of the flow rate control valves provided between the liquid temperature adjusting device and heat exchange units, the supplied amount of liquid medium that is supplied to each heat exchange unit can be individually changed and the heat exchange ratio of ink and liquid medium in each heat exchange unit can be varied for each heat exchange unit. As a result, the temperature of liquid supplied to each liquid ejection head can be individually adjusted, ejection stability of each liquid ejection head can be stabilized, and inconveniences such as density unevenness caused by the difference in liquid temperature can be eliminated. Further, since the temperature of liquid supplied to each liquid ejection head can be adjusted for each type of liquid (for example, for each color of liquid) by changing the supplied amount of liquid medium supplied to each heat exchange unit, no excess temperature adjustment capability is required for each type of liquid and cost can be reduced.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DESCRIPTION OF THE PREFERRED EMBODIMENTS

General Configuration of Inkjet Recording Apparatus

Figure 1:
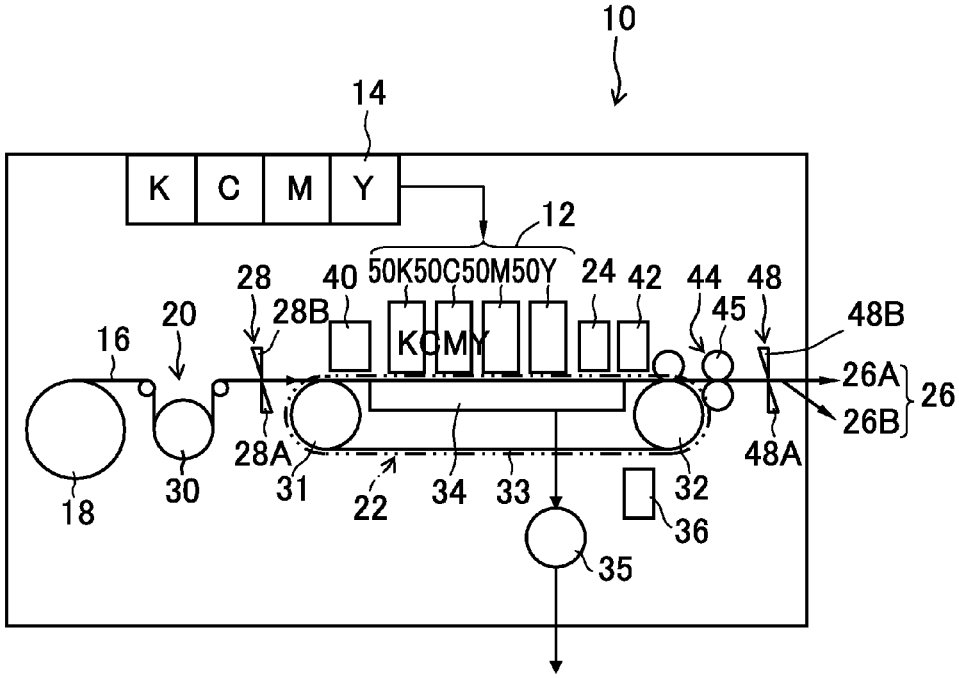
FIG. 1 is a general configuration drawing illustrating schematically an inkjet recording apparatus.

FIG. 1 is a general schematic configuration diagram of an inkjet recording apparatus according to an embodiment of an image forming apparatus of the present invention. As illustrated in FIG. 1, the inkjet recording apparatus 10 comprises: a printing unit 12 having a plurality of recording heads (hereafter, also simply called "heads") 50K, 50C, 50M, and 50Y provided for the respective ink colors; an ink storing and loading unit 14 for storing inks of K, C, M and Y to be supplied to the printing heads 50K, 50C, 50M, and 50Y; a paper supply unit 18 for supplying recording paper 16; a decurling unit 20 removing curl in the recording paper 16; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of the configuration in which roll paper is used, a cutter 28 is provided as illustrated in FIG. 1, and the continuous paper is cut into a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut papers are used, the cutter 28 is not required.

In the case of a configuration in which a plurality of types of recording paper can be used, it is desirable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is desirably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as illustrated in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, and a combination of these. In the case of the configuration in which the belt 33 is nipped with the cleaning rollers, it is desirable to make the line velocity of the cleaning rollers different from that of the belt 33 to improve the cleaning effect.

A roller nip conveyance mechanism, in place of the suction belt conveyance unit 22, can be employed. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is desirable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
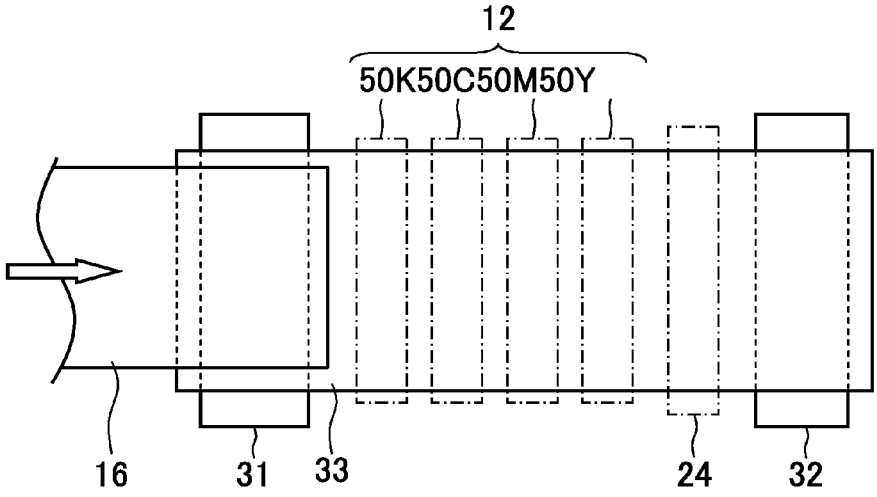
FIG. 2 is a principal plan view illustrating a printing unit periphery of the inkjet recording apparatus.

The printing unit 12 is a so-called "full line head" in which a line head having a length corresponding to the maximum paper width is arranged in a direction (main scanning direction) that is perpendicular to the paper conveyance direction (sub scanning direction). Each of the printing heads 50K, 50C, 50M, and 50Y constituting the printing unit 12 is constituted by a line head, in which a plurality of ink ejection ports (nozzles) are arranged along a length that exceeds at least one side of the maximum-size recording paper 16 intended for use in the inkjet recording apparatus 10 (see FIG. 2).

The printing heads 50K, 50C, 50M, and 50Y are arranged in the order of black (K), cyan (C), magenta (M), and yellow (Y) from the upstream side, along the feed direction of the recording paper 16 (hereinafter, referred to as the sub-scanning direction). A color image can be formed on the recording paper 16 by ejecting the inks from the printing heads 50K, 50C, 50M, and 50Y, respectively, onto the recording paper 16 while conveying the recording paper 16.

By adopting the printing unit 12 in which the full line heads covering the full paper width are provided for the respective ink colors in this way, it is possible to record an image on the full surface of the recording paper 16 by performing just one operation of relatively moving the recording paper 16 and the printing unit 12 in the paper conveyance direction (the sub-scanning direction), in other words, by means of a single sub-scanning action. Higher-speed printing is thereby made possible and productivity can be improved in comparison with a shuttle type head configuration in which a head reciprocates in a direction (the main scanning direction) orthogonal to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added. Furthermore, there are no particular restrictions of the sequence in which the heads of respective colors are arranged.

As illustrated in FIG. 1, the ink storing and loading unit 14 has tanks for storing the inks of K, C, M and Y to be supplied to the heads 50K, 50C, 50M, and 50Y, and the tanks are connected to the heads 50K, 50C, 50M, and 50Y by means of channels, which are omitted from figures. The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 50K, 50C, 50M, and 50Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 50K, 50C, 50M, and 50Y for the respective colors, and the ejection of each head is determined. The ejection determination includes measurement of the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is desirable to avoid contact with the printed surface until the printed ink dries, and a device that blows heated air onto the printed surface is desirable.

In cases in which printing is performed with dye-based ink on porous paper, blocking the pores of the paper by the application of pressure prevents the ink from coming contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are desirably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not illustrated in FIG. 1, the paper output unit 26A for the target prints is provided with a sorter for collecting prints according to print orders.

Structure of Head

Next, the structure of heads 50K, 50C, 50M, and 50Y will be described. The heads 50K, 50C, 50M, and 50Y of the respective ink colors have the same structure, and a reference numeral 50 is hereinafter designated to any of the heads.

Figure 3A:
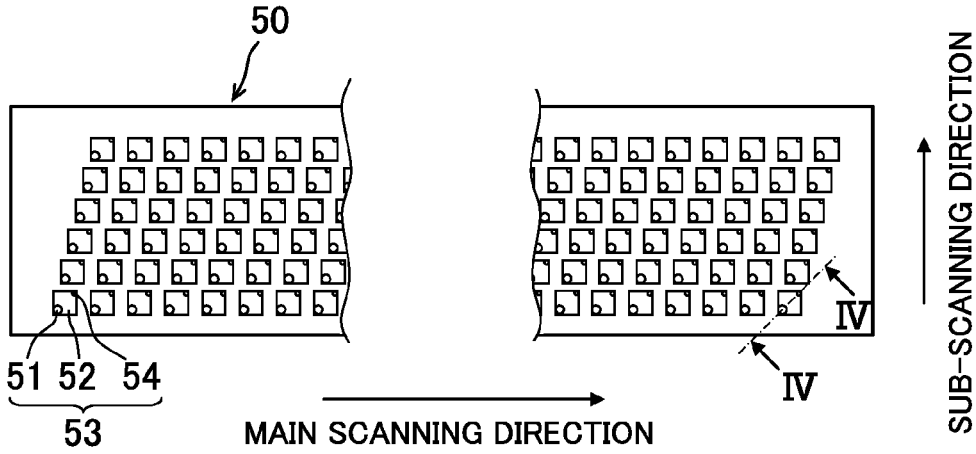
FIGS. 3A to 3C are plan transparent views illustrating examples of head structure.
Figure 3B:
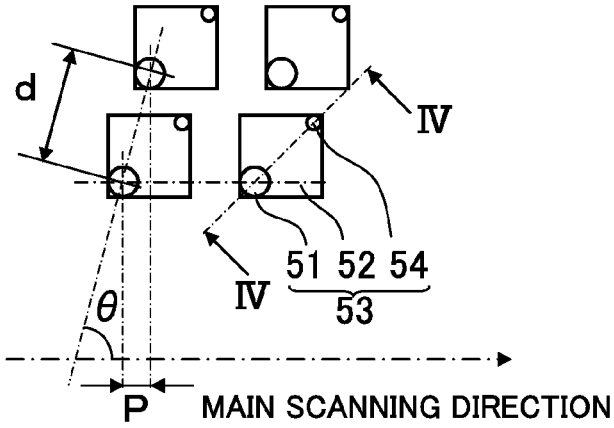
Figure 3C:
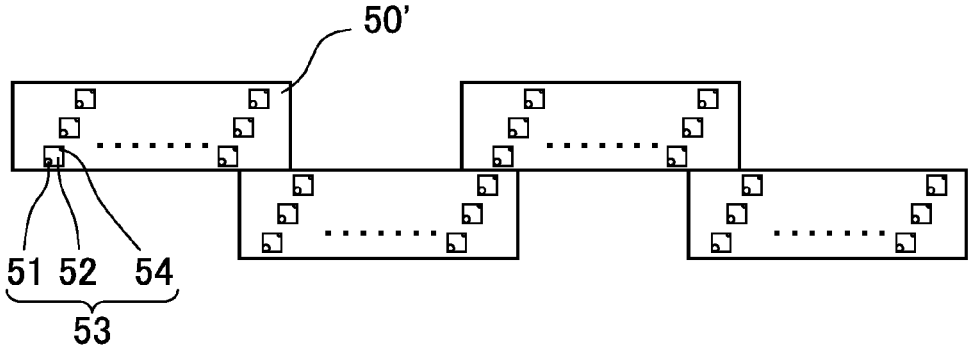
Figure 4:
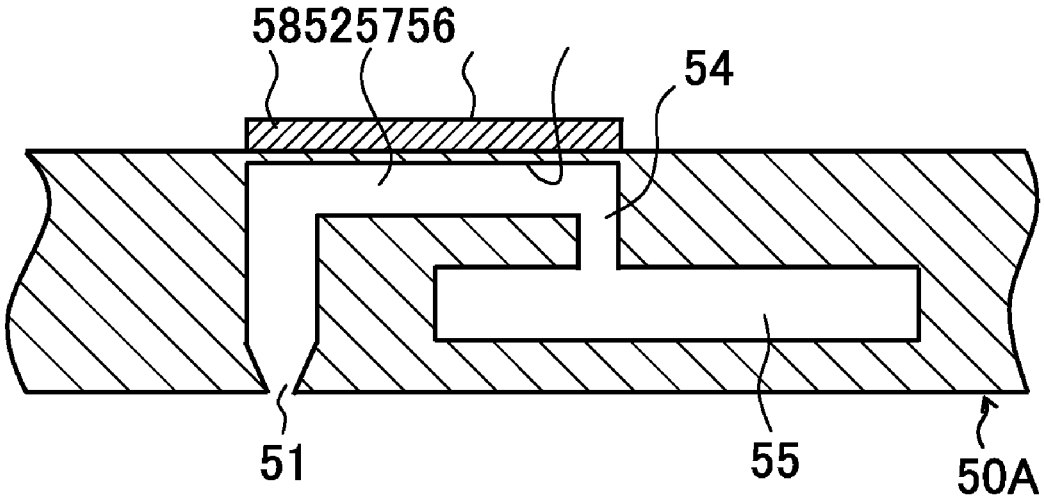
FIG. 4 is a cross-sectional view illustrating an ink chamber unit.

FIG. 3A is a plan perspective diagram showing an example of the structure of a head 50, and FIG. 3B is a partial enlarged diagram of same. Moreover, FIG. 3C is a plan view perspective diagram showing a further example of the structure of the head 50. FIG. 4 is a cross-sectional diagram showing the composition of an ink chamber unit (a cross-sectional diagram along line IV-IV in FIGS. 3A and 3B).

The nozzle pitch in the head 50 should be minimized in order to maximize the density of the dots formed on the surface of the recording paper. As illustrated in FIGS. 3A and 3B, the head 50 according to the present embodiment has a structure in which a plurality of ink chamber units 53, each comprising a nozzle 51 forming an ink droplet ejection hole, a pressure chamber 52 corresponding to the nozzle 51, and the like, are disposed two-dimensionally in the form of a staggered matrix, and hence the effective nozzle interval (the projected nozzle pitch) as projected in the lengthwise direction of the head (the main scanning direction perpendicular to the paper conveyance direction) is reduced and high nozzle density is achieved.

The mode of forming one or more nozzle rows through a length corresponding to the entire width of the recording paper 16 in a direction substantially perpendicular to the paper conveyance direction is not limited to the example described above. For example, instead of the configuration in FIG. 3A, as illustrated in FIG. 3C, a line head having nozzle rows of a length corresponding to the entire width of the recording paper 16 can be formed by arranging and combining, in a staggered matrix, short modules (head chips) 50' having a plurality of nozzles 51 arrayed in a two-dimensional fashion. Furthermore, although not shown in the drawings, it is also possible to compose a line head by arranging short heads in one row.

The pressure chambers 52 provided corresponding to the respective nozzles 51 are approximately square-shaped in planar form, and a nozzle 51 and an ink inflow port 54 are provided respectively at either corner of a diagonal of each pressure chamber 52. Each pressure chamber 52 is connected via the ink inflow port 54 to a common flow channel 55.

Piezoelectric elements 58 respectively provided with individual electrodes 57 are bonded to a diaphragm 56 which forms the upper face of the pressure chambers 52 and also serves as a common electrode, and each piezoelectric element 58 is deformed when a drive voltage is supplied to the corresponding individual electrode 57, thereby causing ink to be ejected from the corresponding nozzle 51. When ink is ejected, new ink is supplied to the pressure chambers 52 from the common flow channel 55, via the ink inlet ports 54.

In the present example, a piezoelectric element 58 is used as an ink ejection force generating device which causes ink to be ejected from a nozzle 50 provided in a head 51, but it is also possible to employ a thermal method in which a heater is provided inside the pressure chamber 52 and ink is ejected by using the pressure of the film boiling action caused by the heating action of this heater.

As illustrated in FIG. 3B, the high-density nozzle head according to the present embodiment is achieved by arranging a plurality of ink chamber units 53 having the above-described structure in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P along the main scanning direction. Such configuration results in a nozzle structure in which the nozzle row projected in the main scanning direction has a high nozzle density of up to 2,400 nozzles per inch.

When implementing the present invention, the arrangement structure of the nozzles is not limited to the example shown in the drawings, and it is also possible to apply various other types of nozzle arrangements, such as an arrangement structure having one nozzle row in the sub-scanning direction.

Furthermore, the scope of application of the present invention is not limited to a printing system based on a line type of head, and it is also possible to adopt a serial system where a short head which is shorter than the breadthways dimension of the recording paper 16 is scanned in the breadthways direction (main scanning direction) of the recording paper 16, thereby performing printing in the breadthways direction, and when one printing action in the breadthways direction has been completed, the recording paper 16 is moved through a prescribed amount in the direction perpendicular to the breadthways direction (the sub-scanning direction), printing in the breadthways direction of the recording paper 16 is carried out in the next printing region, and by repeating this sequence, printing is performed over the whole surface of the printing region of the recording paper 16.

Configuration of Control System

Figure 5:
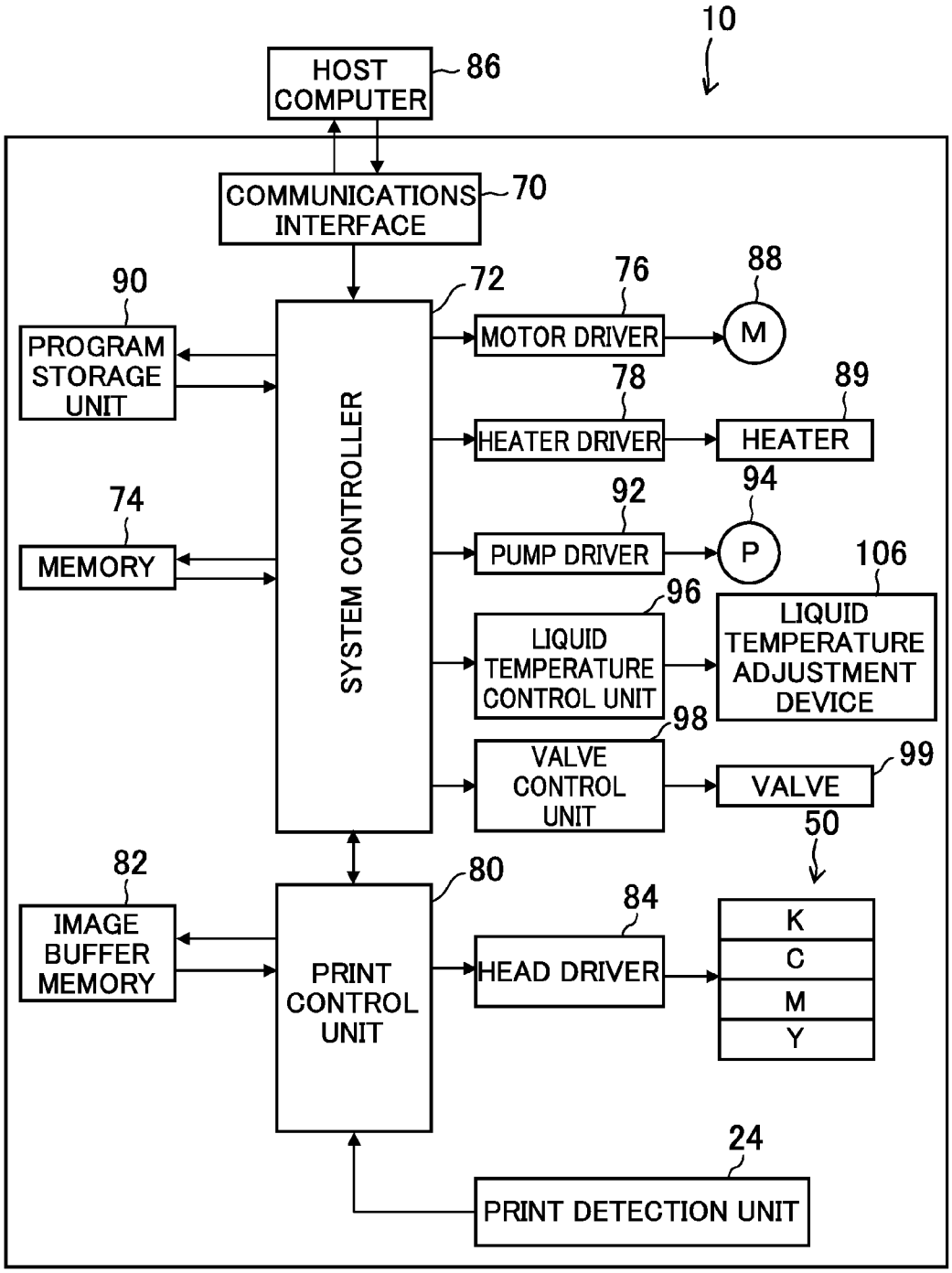
FIG. 5 is a principal block diagram illustrating a control system of the inkjet recording apparatus.

FIG. 5 is a principal block diagram showing the control system of the inkjet recording apparatus 10. The inkjet recording apparatus 10 comprises a communications interface 70, a system controller 72, a memory 74, a motor driver 76, a heater driver 78, a print control unit 80, an image buffer memory 82, a head driver 84, a liquid temperature control unit 96, a valve control unit 98, and the like.

The communications interface 70 is an interface unit for receiving image data sent from a host computer 86. A serial interface such as USB (Universal Serial Bus), IEEE1394, Ethernet (registered trademark), wireless network, or a parallel interface such as a Centronics interface may be used as the communications interface 70. A buffer memory (not shown) may be mounted in this portion in order to increase the communication speed.

The image data sent from the host computer 86 is received by the inkjet recording apparatus 10 through the communications interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit which controls the respective sections, such as the communications interface 70, the memory 74, the motor driver 76, the heater driver 78, the pump driver 92, the liquid temperature control unit 96, the valve control unit 98, and the like. The system controller 72 is made up of a central processing unit (CPU) and peripheral circuits thereof, and as well as controlling communications with the host computer 86 and controlling reading from and writing to the memory 74, and the like, and it generates control signals for controlling the motors 88 of the conveyance system and the heaters 89.

Programs executed by the CPU of the system controller 72 and the various types of data which are required for control procedures are stored in the memory 74. The memory 74 may be a non-writeable storage device, or it may be a rewriteable storage device, such as an EEPROM. The memory 74 is used as a temporary storage region for the image data, and it is also used as a program development region and a calculation work region for the CPU.

Various control programs are stored in the program storage unit 90, and the control programs are read and executed in response to indications of the system controller 72. The program storage unit 90 may use a semiconductor memory such as ROM or an EEPROM, or may use a magnetic disk or the like. An external interface may be provided and a memory card or a PC card may be used. It goes without saying that a plurality of recording media may be selected from among these recording media. The program storage unit 90 may be also used together with a storage device (not shown in the figure) of an operation parameter or the like.

The motor driver (drive circuit) 76 drives the motor 88 in accordance with commands from the system controller 72. The heater driver 78 drives the heater 89 of the post-drying unit 42 and the like in accordance with commands from the system controller 72.

The pump driver 92 is a driver that drives the pump 94 according to an instruction from the system controller 72. The pump 94 shown in FIG. 5 includes pumps (for example, a pump 102 in FIG. 6) disposed in the ink supply system of the inkjet recording apparatus 10.

The liquid temperature control unit 96 is a control unit that controls the temperature of liquid medium (cooling water) of the liquid temperature adjusting device 106 according to an instruction from the system controller 72. As will be described below, the liquid temperature adjusting device 106 is provided as a device shared by all colors, rather than for each ink color, and the liquid medium adjusted to the predetermined temperature by the liquid temperature adjusting device 106 circulates in the heat exchange units 104 (see FIG. 6) provided respectively for the colors.

The valve control unit 98 controls the valve 99 according to an instruction from the system controller 72. The valve 99 shown in FIG. 5 includes the flow rate control valve 108 shown in FIG. 6 and the electromagnetic valve 132 shown in FIG. 10.

The print control unit 80 has a signal processing function for performing various tasks, compensations, and other types of processing for generating print control signals from the image data stored in the memory 74 in accordance with commands from the system controller 72 so as to supply the generated print control signals (dot data) to the head driver 84. Necessary signal processing is carried out in the print control unit 80, and the ejection amount and the ejection timing of the ink from the respective recording heads 50 are controlled via the head driver 84, on the basis of the print data. By this means, desired dot size and dot positions can be achieved.

The print control unit 80 is provided with the image buffer memory 82; and image data, parameters, and other data are temporarily stored in the image buffer memory 82 when image data is processed in the print control unit 80. The aspect illustrated in FIG. 5 is one in which the image buffer memory 82 accompanies the print control unit 80; however, the memory 74 may also serve as the image buffer memory 82. Also possible is an aspect in which the print control unit 80 and the system controller 72 are integrated to form a single processor.

The head driver 84 generates drive signals for driving the piezoelectric elements 58 (see FIG. 4) of the recording heads 50 of the respective colors, on the basis of dot data supplied from the print control unit 80, and supplies the generated drive signals to the piezoelectric elements 58. A feedback control system for maintaining constant drive conditions in the recording heads 50 may be included in the head driver 84.

The print determination unit 24 is a block that includes the line sensor as described above with reference to FIG. 1, reads the image printed on the recording paper 16, determines the print conditions (presence of the ejection, variation in the dot formation, and the like) by performing prescribed signal processing, and the like, and provides the determination results of the print conditions to the print control unit 80.

According to requirements, the print control unit 80 makes various corrections with respect to the recording head 50 on the basis of information obtained from the print determination unit 24.

Configuration of Ink Supply System

Configuration examples (first and second embodiments) of ink supply system (ink supply device) of the inkjet recording apparatus 10, which is a specific component in accordance with the present invention, will be explained below. The reference numerals of components provided for each color will be assigned at the right end thereof with an alphabet letter (C/M/Y/K) indicating each color, but when the explanation is given without distinguishing the colors, the alphabet letter and the right end of reference numeral will be omitted.

First Embodiment

Figure 6:
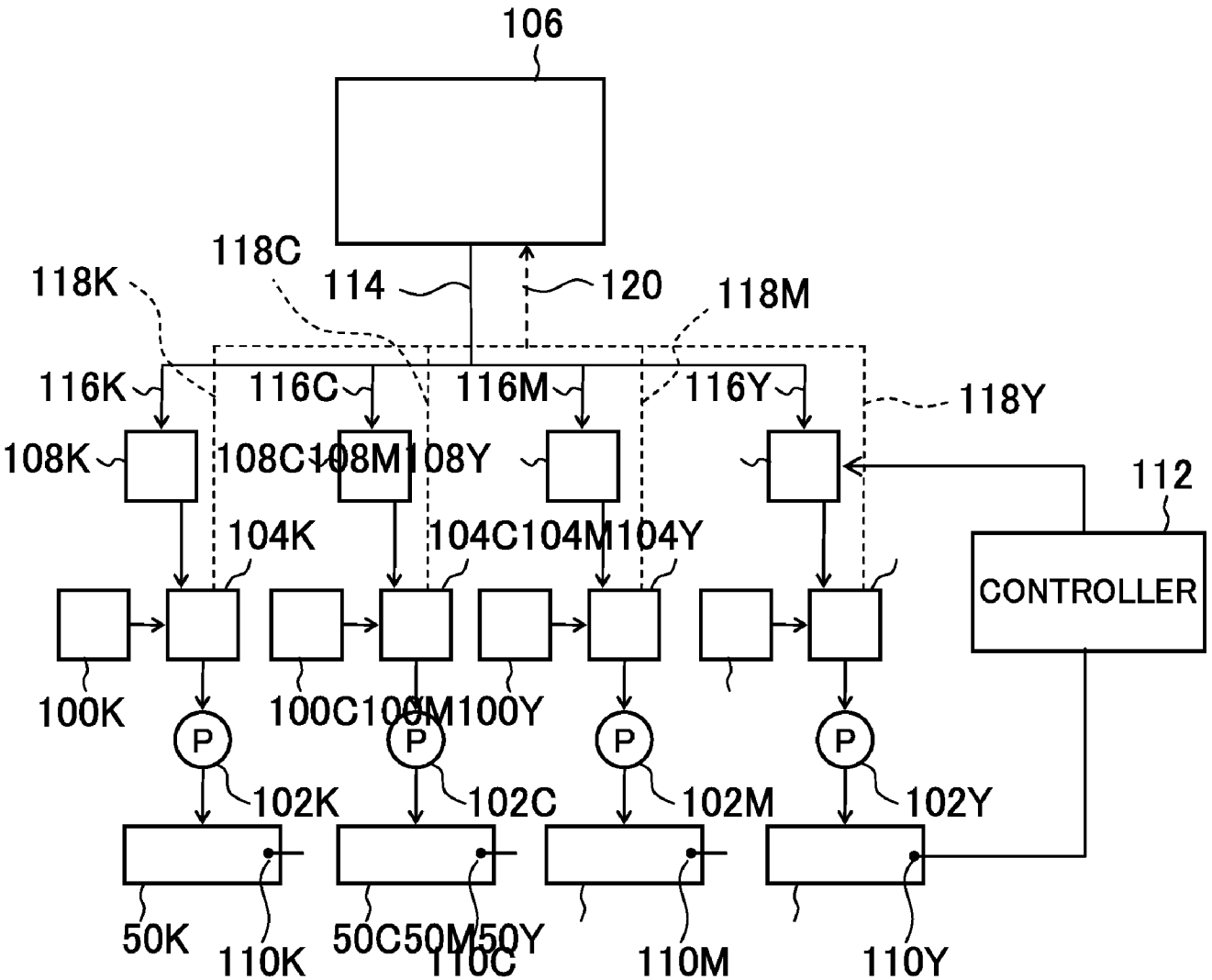
FIG. 6 is a schematic drawing illustrating a configuration example of an ink supply system according to a first embodiment.

FIG. 6 is a schematic drawing illustrating a configuration example of ink supply system according to a first embodiment. As shown in FIG. 6, the ink supply system according to the first embodiment is constituted mainly by a head 50, a liquid storage unit 100, a pump 102, and a heat exchange unit 104 for each ink color.

The ink storage unit 100 is a basic tank (ink supply source) accommodating ink for supply to each corresponding head 50 and corresponds to a tank disposed in the ink storage/loading unit 14 shown in FIG. 1.

The pump 102 is a pumping device installed between the liquid storage unit 100 and the head 50. By driving the pump 102, the ink is supplied from the liquid storage unit 100 to the head 50. In the configuration shown by way of the example in FIG. 6, the pump 102 is installed between the heat exchange unit 104 and the head 50, but this configuration is not limiting, and the pump 102 may be also installed between the liquid storage unit 100 and the heat exchange unit 104.

The heat exchange unit 104 is a heat exchange device installed between the liquid storage unit 100 and the head 50. The liquid medium (cooling water) supplied from the below-described liquid temperature adjusting device 106 is circulated in the heat exchange unit 104, and when the ink is supplied from the liquid storage unit 100 to the head 50, the temperature of ink passing through the heat exchange unit 104 is adjusted by heat exchange with the liquid medium.

The liquid temperature adjusting device (chiller) 106 is a device that causes the liquid medium (cooling water) adjusted to the predetermined temperature to circulate between the liquid temperature adjusting device 106 and each heat exchange unit 104. The liquid medium adjusted to the predetermined temperature in the liquid temperature adjusting device 106 is supplied to each heat exchange unit 104 via a plurality of first branch flow paths 116 which branch off from one supply flow path 114. The liquid medium that has circulated inside the heat exchange units 104 and has been discharged is returned from second branch flow paths 118 respectively connected to the heat exchange units 104 to the liquid temperature adjusting device 106 via a single merged recovery flow path 120. The liquid temperature adjusting device 106 incorporates a pump (not shown in the figures) as a pumping device for causing the liquid medium to circulate between the liquid temperature adjusting device 106 and the heat exchange units 104. The pump can be also provided outside the liquid temperature adjusting device 106.

Respective flow rate control valves 108 are provided between the liquid temperature adjusting device 106 and the heat exchange units 104. The flow rate control valves 108 are flow rate adjusting devices that adjust the supplied amount (circulated amount) of liquid medium (cooling water) supplied from the liquid temperature adjusting device 106 to the heat exchange units 104. The flow rate control valves 108 are controlled by the below-described controller 112.

Each head 50 is provided with a temperature sensor 110. The temperature sensor 110 is an ink temperature measuring device that measures the temperature of ink inside the head 50. The controller 112 is notified of the ink temperature (measured value) measured by the temperature sensor 110. The temperature sensor 110 may measure not only the temperature of ink inside the head 50, but also the temperature of ink flowing in a flow path connected to the head 50.

The controller 112 changes the opening area (opening ratio) of the corresponding flow rate control valve 108 on the basis of ink temperature sent from each temperature sensor 110, so as to control the supplied amount (circulated amount)

of liquid medium supplied from the liquid temperature adjusting device 106 to each heat exchange unit 104. The controller 112 is a controller corresponding to the system controller 72 and valve control unit 98 shown in FIG. 5.

Figure 7:
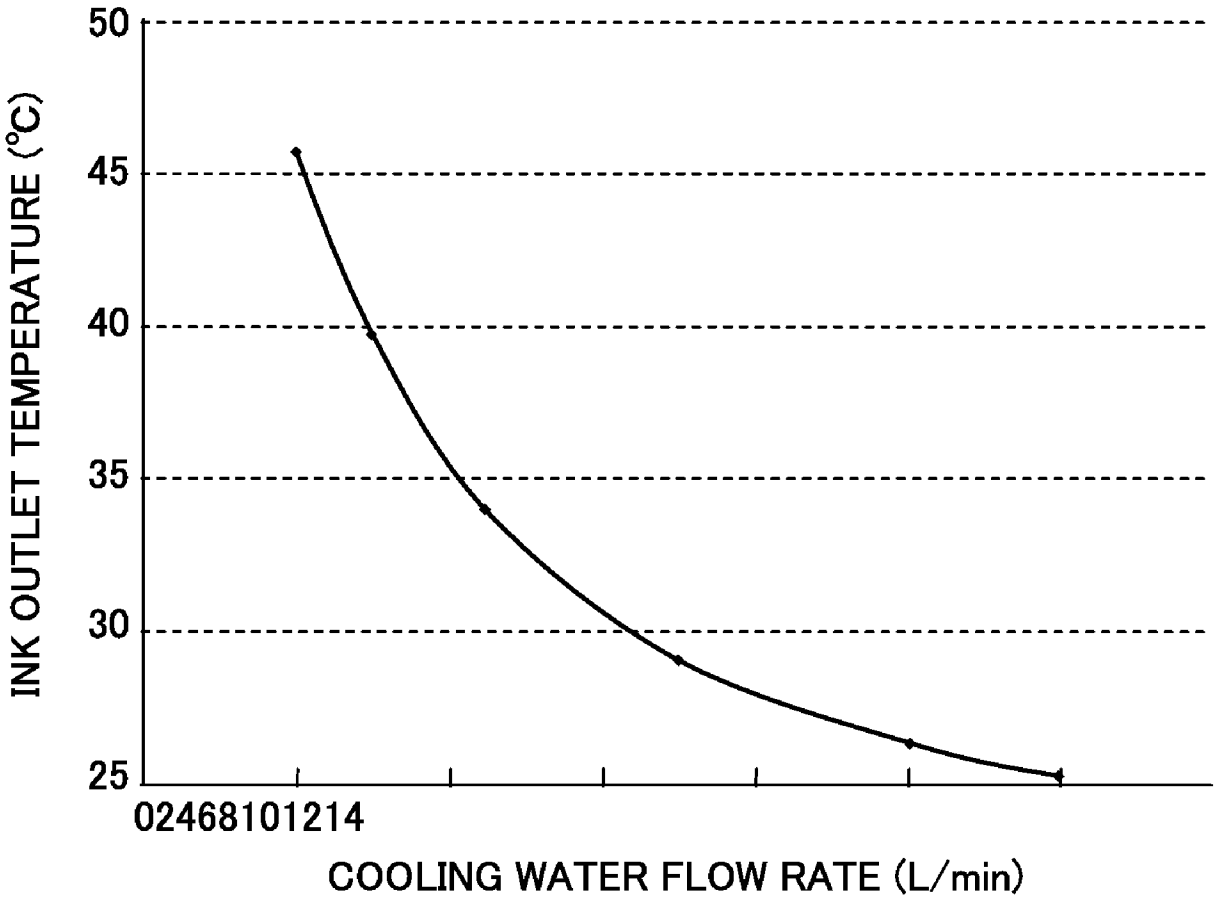
FIG. 7 is a graph showing an example of relationship between the cooling water flow rate and warm water outlet temperature.

FIG. 7 shows how the ink outlet temperature (outlet temperature of ink flowing out from the heat exchange unit 104) varies when the cooling water flow rate is changed in the case in which cooling water is used as the liquid medium. The graph in FIG. 7 shows the relationship between the cooling water flow rate and the ink outlet temperature when the ink inlet temperature (inlet temperature of ink flowing into the heat exchange unit 104) is taken as 64° C. and the cooling water inlet temperature (temperature of cooling water supplied to the heat exchange unit 104) is taken as 18° C. As indicated in this graph, when the cooling water flow rate is increased, the heat exchange ratio in the heat exchange unit 104 rises, the ink can be better cooled by the heat exchange unit 104 and the ink outlet temperature can be lowered.

Accordingly, with the controller 112 of the present embodiment, when the temperature of ink inside the head 50 is higher than a reference value, the flow rate control valve 108 is controlled so as to increase the flow rate of liquid medium circulating in the heat exchange unit 104. As a result, the heat exchange ratio in the heat exchange unit 104 can be raised and the temperature of ink supplied to the head 50 (outlet temperature of ink flowing out from the heat exchange unit 104) can be lowered.

When the temperature of ink inside the head 50 is lower than the reference value, the controller 112 controls the flow rate control valve 108 so as to reduce the flow rate of liquid medium circulating in the heat exchange unit 104. As a result, the heat exchange ratio in the heat exchange unit 104 can be reduced and the temperature of ink supplied to the head 50 can be raised.

The configuration example shown in FIG. 6 relates to a feedback control system in which a difference between the temperature of ink supplied to the head 50 and the reference value (reference temperature) is reflected in the opening ratio of the flow rate control valve 108.

Instead of the configuration example shown in FIG. 6, it is possible to maintain a table indicating the relationship between the temperature of ink supplied to the head 50 and the opening ratio of the flow rate control valve 108, and apply feedforward control that determines the opening ratio of the flow rate control valve 108 correspondingly to the ink temperature.

A specific example will be described below. For example, when a solid image of cyan color is formed, only a head 50C corresponding to the ink of cyan color, from among the plurality of heads 50C, 50M, 50Y, 50K, generates heat and therefore the temperature of ink inside the head 50C rises. In such a case, the opening area (opening degree) of the flow rate control valve 108C corresponding to the head 50C is increased, the supplied amount of liquid medium supplied to the heat exchange unit 104C is raised in such a manner that the heat exchange ratio (temperature adjustment efficiency) of the heat exchange unit 104C is increased.

Further, when a black text image is formed, only a head 50K corresponding to the ink of black color, from among the plurality of heads 50C, 50M, 50Y, 50K, generates heat and therefore the temperature of ink inside the head 50K rises. In such a case, the opening area (opening degree) of the flow rate control valve 108K corresponding to the head 50K is increased, the supplied amount of liquid medium supplied to the heat exchange unit 104C is raised and the heat exchange ratio (temperature adjustment efficiency) of the heat exchange unit 104C is increased. The increase in the opening area (opening degree) of the flow rate control valve 108 may not be as large as in the case in which the aforementioned solid image is formed.

When a diagram (graphic) composed of a plurality of colors is formed, one or a plurality of heads 50 corresponding to colors with a high ejection ratio, from among the plurality of heads 50C, 50M, 50Y, 50K, generates heat. Therefore, the opening area (opening degree) of the flow rate control valve 108 corresponding to the head 50 with a high ejection ratio is increased, the supplied amount of liquid medium supplied to the corresponding heat exchange unit 104 is raised and the heat exchange ratio (temperature adjustment efficiency) of the heat exchange unit 104 is increased.

Thus, according to the first embodiment, by controlling each flow rate control valve 108 provided between the liquid temperature adjusting device 106 and the heat exchange units 104, it is possible to change individually the supplied amount (circulated amount) of liquid medium supplied to each heat exchange unit 104 and vary the heat exchange ratio between the ink and liquid medium in each heat exchange unit 104 with respect to each heat exchange unit 104 (that is, with respect to each ink color). As a result, the temperature of ink supplied to the head 50 corresponding to each color can be individually adjusted, ejection of each head 50 can be stabilized, and inconveniences such as density unevenness caused by the difference in ink temperature can be eliminated.

Further, since the temperature of ink supplied to each head 50 can be adjusted for each ink color (each head) only by changing the supplied amount of liquid medium supplied to each heat exchange unit 104, no excess temperature adjustment capability is required for each ink color and cost can be reduced.

Further, in the present embodiment, the feedback control system configuration is shown in which the flow rate control valve 108 is controlled on the basis of ink temperature inside the head 50, but such a configuration is not limiting, and a configuration of feedback control system conducting control on the basis of ink amount (flow rate) supplied to the head 50 or ejection ratio of the head 50 is also beneficial.

Figure 8:
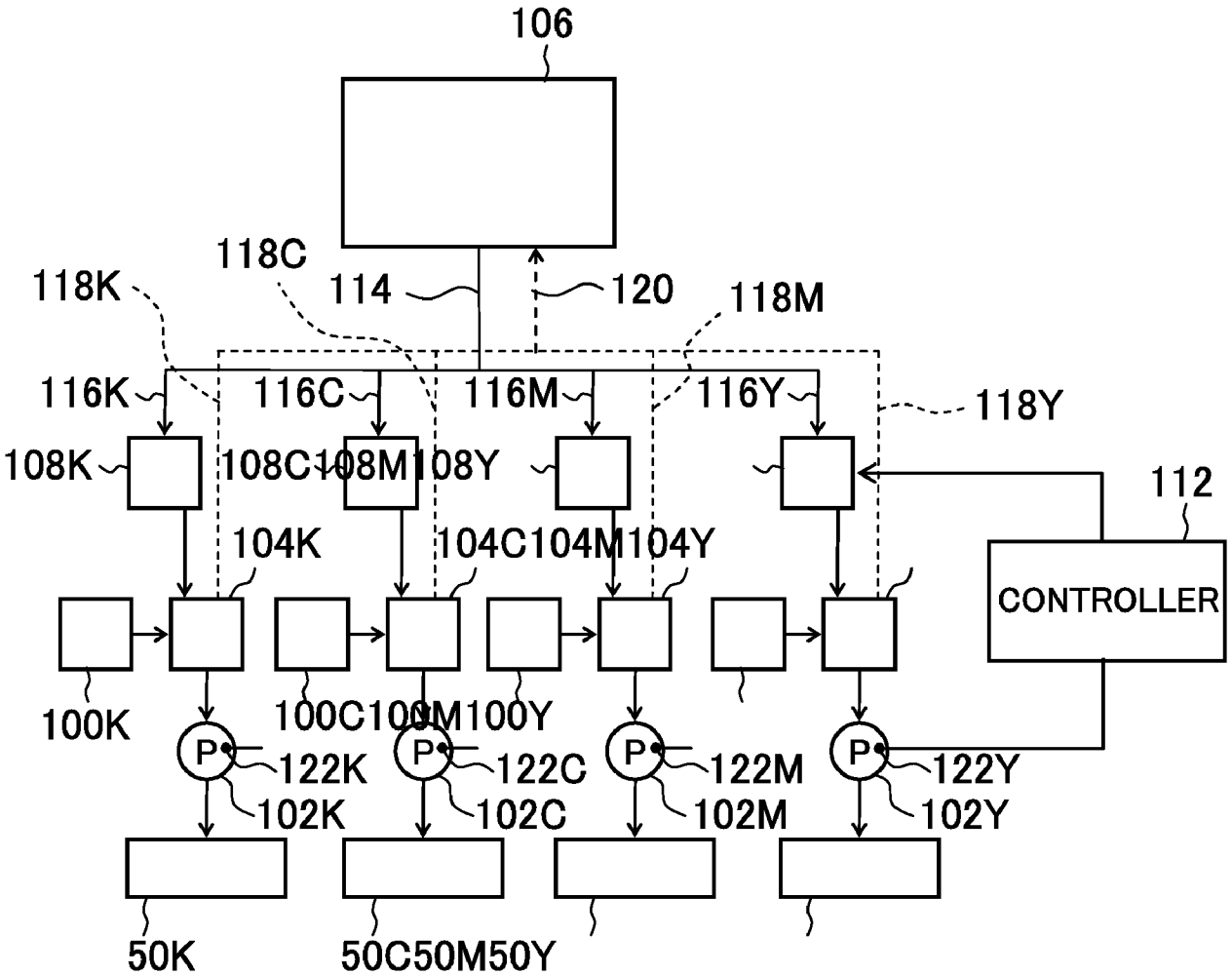
FIG. 8 is a schematic diagram illustrating another configuration example of an ink supply system according to the first embodiment.

FIG. 8 is a schematic diagram illustrating another configuration example of ink supply system according to the first embodiment. In FIG. 8, components common or analogous to those shown in FIG. 6 are assigned with like numeral symbols and explanation thereof is omitted.

The configuration shown in FIG. 8 is provided with a plurality of revolution speed sensors 122 (122K, 122C, 122M, 122Y) that determine revolution speed of the pumps 102 respectively. Each revolution speed sensor 122 detects the revolution speed of the corresponding pump 102, and notifies the controller 112 of the detection result. The controller 112 controls the corresponding flow rate control valve 108 on the basis of the detected value (revolution speed of the pump 102) received from each revolution speed sensor 122.

For example, when the revolution speed of the pump 102 detected by the revolution speed sensor 122 is lower than a reference value, the supplied amount of ink supplied to the head 50 is small, the heat exchange efficiency in the heat exchange unit 104 rises, and the temperature of ink supplied to the head 50 tends to decrease. Therefore, the controller 112 controls the flow rate control valve 108 so that the flow rate of liquid medium circulating in the heat exchange unit 104 decreases. As a result, the heat exchange efficiency (heat exchange rate) in the heat exchange unit 104 decreases, the temperature of ink supplied to the head 50 rises, and the ink temperature inside the head 50 gradually approaches the reference value.

When the revolution speed of the pump 102 detected by the revolution speed sensor 122 is higher than the reference value, the supplied amount of ink supplied to the head 50 is large, the heat exchange efficiency in the heat exchange unit 104 decreases, and the temperature of ink supplied to the head 50 tends to rise. Therefore, the controller 112 controls the flow rate control valve 108 so that the flow rate of liquid medium circulating in the heat exchange unit 104 increases. As a result, the heat exchange efficiency (heat exchange rate) in the heat exchange unit 104 increases, the temperature of ink supplied to the head 50 is lowered, and the ink temperature inside the head 50 gradually approaches the reference value.

In the configuration example shown in FIG. 8, the revolution speed sensors 122 detecting the revolution speed of the pumps 102 are provided as a means for detecting the amount of ink supplied to the heads 50, but this configuration is not limiting and a flow rate sensor detecting the flow rate (ink supply amount) in the ink supply paths from the liquid storage unit 100 towards the heads 50 may be also provided. In this case, the controller 112 controls each flow rate control valve 108 so as to increase or decrease the heat exchange efficiency of each heat exchange unit 104 on the basis of ink amount detected by each flow rate sensor.

In the configuration example shown in FIG. 8, a table indicating the relationship between the revolution speed of the pump 102 and the opening ratio of the flow rate control valve 108 is maintained and feedforward control is performed by which the opening ratio of the flow rate control valve 108 is changed according to the revolution speed of the pump 102.

Figure 9:
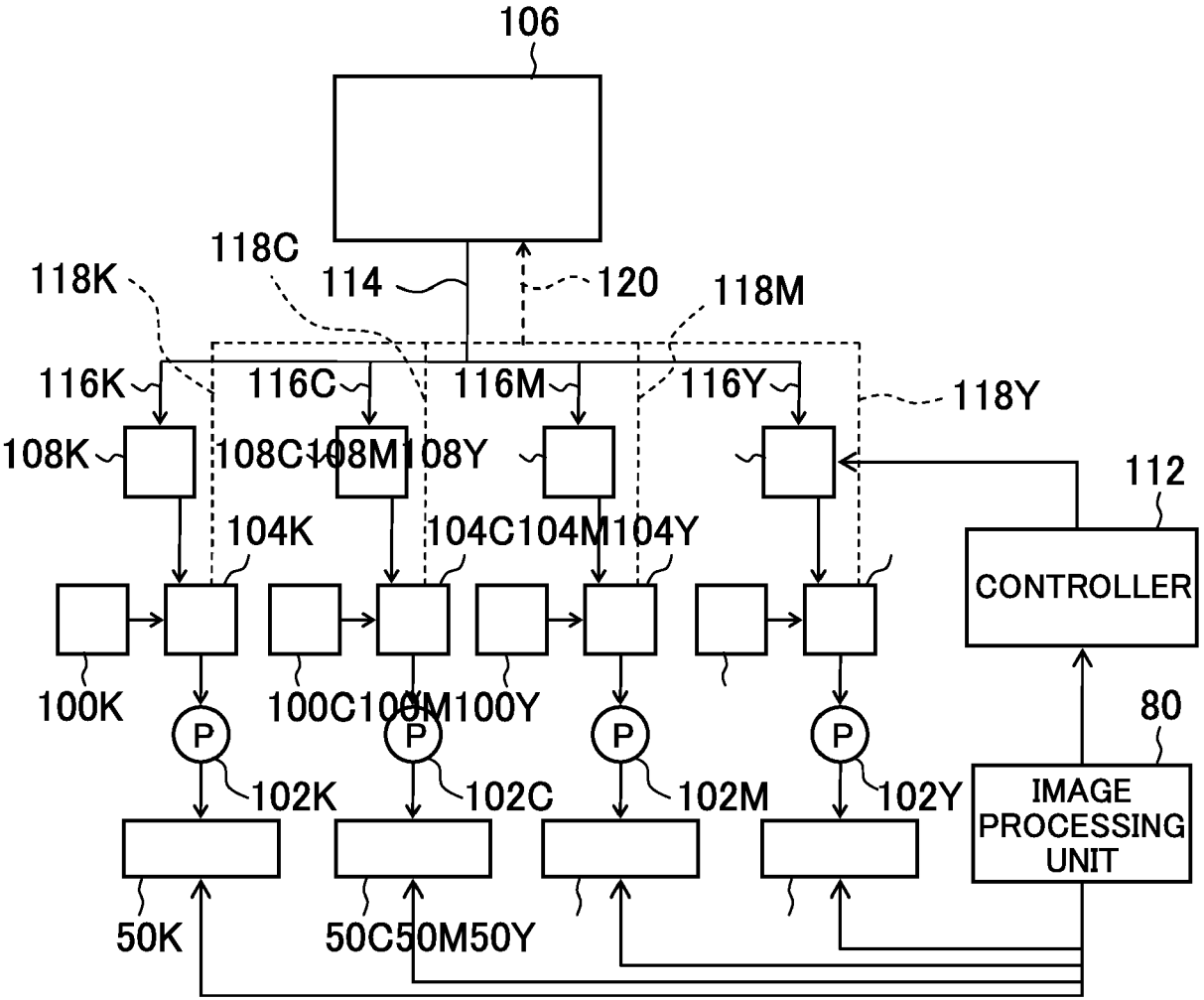
FIG. 9 is a schematic diagram illustrating yet another configuration example of the ink supply system according to the first embodiment.

FIG. 9 is a schematic diagram illustrating yet another configuration example of an ink supply system according to the first embodiment. In FIG. 9, components common or analogous to those shown in FIG. 6 are assigned with like numeral symbols and explanation thereof is omitted.

In the configuration shown in FIG. 9, the print control unit 80 (see FIG. 5) generates dot data from input image data, drives each head 50 via the head driver 84 (not shown in FIG. 9) shown in FIG. 5, calculates the ejection ratio of each head 50, and sends the calculation results to the controller 112. The controller 112 controls each flow rate control valve 108 on the basis of the ejection ratio of each head 50 received from the print control unit 80 (see FIG. 5).

For example, when the ejection ratio of the head 50 is low, then it is easy to decrease the temperature of the head 50 since the drive frequency is low, the heat exchange efficiency in the heat exchange unit 104 is high since the supplied amount of ink supplied to the head 50 is small, and therefore the temperature of ink supplied to the head 50 tends to become low. Therefore, the controller 112 controls the flow rate control valve 108 so that the flow rate of liquid medium circulating in the heat exchange unit 104 decreases. As a result, the heat exchange efficiency in the heat exchange unit 104 is low, the temperature of ink supplied to the head 50 rises, and the ink temperature inside the head 50 gradually approaches the reference value.

When the ejection ratio of the head 50 is high, the increase in drive frequency easily rises the temperature of the head 50, the heat exchange efficiency in the heat exchange unit 104 decreases since the supplied amount of ink supplied to the head 50 is large, and therefore the temperature of ink supplied to the head 50 tends to increase. Therefore, the controller 112 controls the flow rate control valve 108 so that the flow rate of liquid medium circulating in the heat exchange unit 104 increases. As a result, the heat exchange efficiency in the heat exchange unit 104 increases, the temperature of ink supplied to the head 50 decreases, and the ink temperature inside the head 50 gradually approaches the reference value.

In the configuration example shown in FIG. 9, a table indicating the relationship between the ejection ratio of the head 50 and the opening ratio of the flow rate control valve 108 is maintained and feedforward control is performed by which the opening ratio of the flow rate control valve 108 is changed according to the ejection ratio of the head 50.

Further, in the present embodiment, a non-circulation system is described in which the ink does not circulate between the liquid storage unit 100 and the head 50, but this configuration is not limiting and the present invention can be similarly applied to a circulation system in which the ink circulates between the liquid storage unit 100 and the head 50.

Second Embodiment

Figure 10:
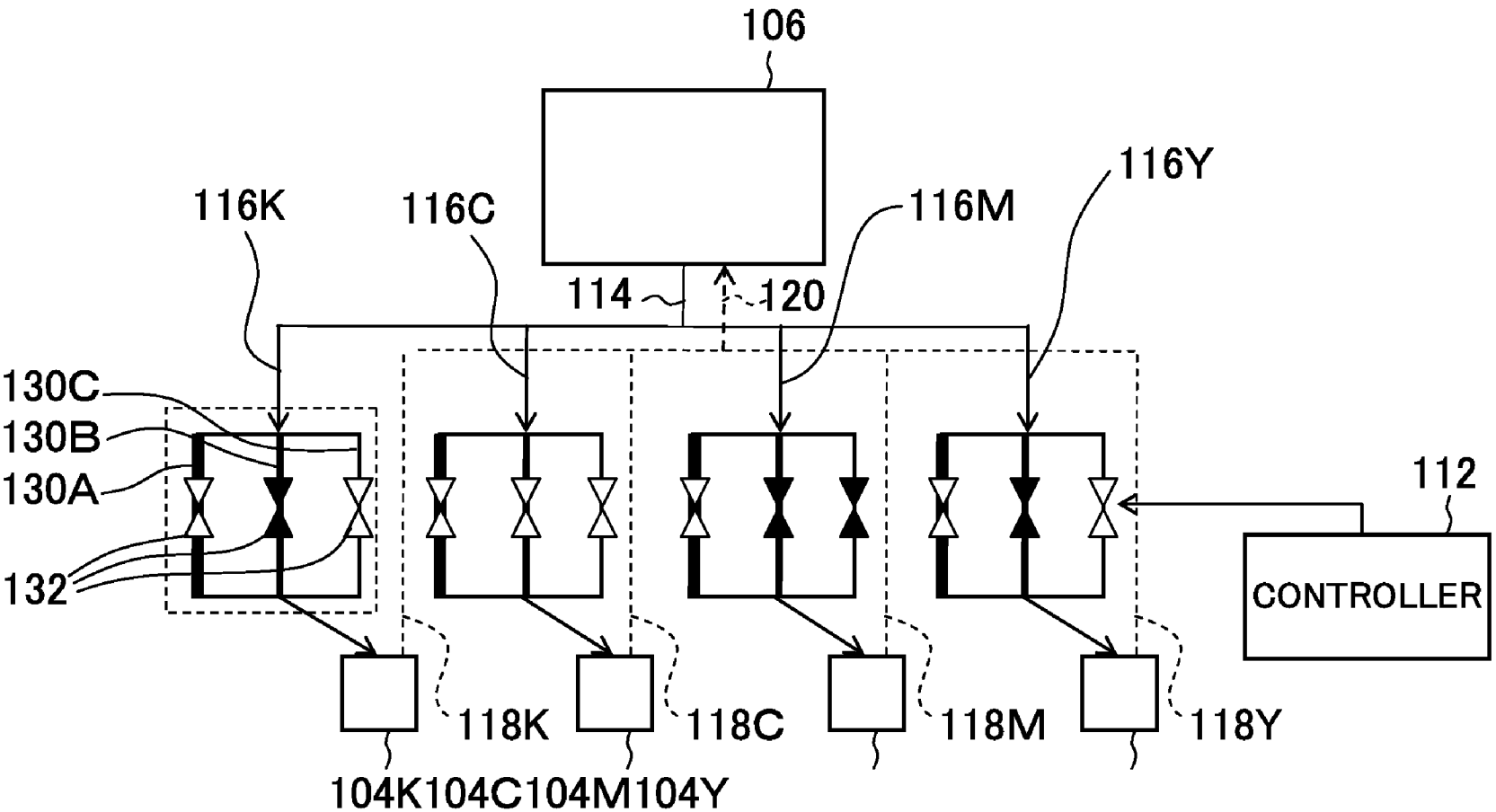
FIG. 10 is a schematic diagram illustrating a configuration example of an ink supply system according to a second embodiment.

FIG. 10 is a schematic diagram illustrating a configuration example of an ink supply system according to a second embodiment. In FIG. 10, components common or analogous to those shown in FIG. 6 are assigned with like numeral symbols and explanation thereof is omitted. Further, components outside the configuration between the liquid temperature adjusting device 106 and the heat exchange units 104 (that is, the configuration between the liquid storage unit 100 and the heads 50) are similar to those of the configuration example shown in FIG. 6. Accordingly these components are not shown in FIG. 10.

As shown in FIG. 10, the ink supply system according to the second embodiment is similar to that of the first embodiment in that the liquid temperature adjusting device 106 and the heat exchange unit 104 are linked by a supply flow path 114 and each of a plurality of first branched flow paths 116 which branch off from the supply flow path 114 is provided with a flow rate adjusting device, but the configuration of the flow rate adjusting device in the second embodiment is different from that in the first embodiment. Thus, in the first embodiment, the flow rate control valves 108 (see FIG. 6) are used, whereas in the second embodiment, electromagnetic valves 132 are used.

In the second embodiment, a plurality of flow paths (referred to hereinbelow as parallel flow paths) 130A, 130B, 130C are connected in parallel to each of the first branched flow paths 116, and the electromagnetic valve 132 is provided in each of the parallel flow paths 130A, 130B, 130C.

Part (some) or all of the parallel flow paths 130A, 130B, 130C may have different flow path resistances, or all of the flow paths may have the same resistance. In the former case, the adjustment range of the supplied amount of liquid medium supplied to each heat exchange unit 104 can be expanded. In the latter case, flow rate control of the liquid medium in the heat exchange units 104 can be simplified because the supplied amount of liquid medium supplied to the heat exchange unit 104 is proportional to the number of parallel flow paths in which the electromagnetic valve 132 is open, from among the parallel flow paths 130A, 130B, 130C corresponding to this heat exchange unit 104.

In the configuration example shown in FIG. 10, the ratio of flow path resistances of the parallel flow paths 130A, 130B, 130C is 1:2:4, and the ratio of flow rates of liquid medium flowing in the parallel flow paths 130A, 130B, 130C is 4:2:1.

In the configuration example shown in FIG. 10, three parallel flow paths 130A, 130B, 130C are connected in parallel to each of the first branched flow paths 116, but the number of parallel flow paths connected in parallel to the first branched flow paths 116 is not limited to this number. Thus, two, or four or more parallel flow paths may be connected in parallel.

Opening and closing of the electromagnetic valves 132 provided in the parallel flow paths 130A, 130B, 130C respectively is controlled by the controller 112. This control by the controller 112 is performed in the same manner as in the first embodiment and explanation thereof is herein omitted to avoid redundancy.

An example of control performed by the controller 112 will be explained below. From among the electromagnetic valves 132 shown in FIG. 10, the electromagnetic valves shown by white symbols are assumed to be in an open state and those shown by black symbols are assumed to be in a closed state. In this case, for example, as shown in FIG. 10, when the opening and closing of the electromagnetic valves 132 is controlled by the controller 112, the ratio of supplied amounts of liquid medium supplied from the liquid temperature adjusting device 106 to the heat exchange units 104 is 5:7:4:5.

Thus, according to the second embodiment, by connecting in parallel a plurality of parallel flow paths 130A to 130C to the first branched flow paths 116 connected to respective heat exchange units 104 and controlling together the opening and closing of electromagnetic valves 132 installed in each of the parallel flow paths 130A to 130C, it is possible to change individually the supply amounts of liquid medium supplied to the heat exchange units 104 and vary the heat exchange ratio of ink and liquid medium in the heat exchange units 104 with respect to each heat exchange unit 104 (that is, with respect to each ink color). As a result, the temperature of ink supplied to the head 50 corresponding to each color can be individually adjusted and inconveniences such as density unevenness caused by the difference in ink temperature can be eliminated. Further, since electromagnetic valves 132 that are less expensive and easier to control than the flow rate control valve 108 (see FIG. 6) are used as the flow rate adjusting means, the cost of the ink supply system (ink supply device) of the inkjet recording apparatus 10 can be reduced.

Further, in the above-described embodiments, the liquid medium is supplied from one liquid temperature adjusting device 106 to a plurality of heat exchange units 104. Therefore, when the supplied amount (circulating amount) of liquid medium to one heat exchange unit 104 is changed by controlling the flow rate control valve 108 or the electromagnetic valve 132, the supplied amount (circulating amount) of liquid medium to another heat exchange unit 104 also changes. As a result, the outlet temperature of ink flowing out of the other heat exchange unit 104 can be assumed to be changed.

Accordingly, the following relationship is valid between the ink inlet temperature (inlet temperature of ink flowing into the heat exchange unit 104), ink outlet temperature (outlet temperature of ink flowing out of the heat exchange unit 104), and liquid medium temperature.

$$\text{Ink Outlet Temperature}=\epsilon\times(\text{Liquid Medium Temperature})+(1-\epsilon)\times(\text{Ink Inlet Temperature}) \quad (1)$$

where $\epsilon$ is a temperature efficiency that can be represented as $\epsilon=\alpha\times W^{1/2}$, $\alpha$ being a physical parameter of the heat exchange unit 104 and W being a liquid medium flow rate (supplied amount of the liquid medium supplied to the heat exchange unit 104). As indicated in Formula (1), as the liquid medium flow rate W changes, the ink outlet temperature also changes.

In a preferred mode of the above-described embodiments, when the controller 112 changes the supplied amount (circulating amount) of liquid medium to one heat exchange unit 104 by controlling the flow rate control valves 108 or the electromagnetic valves 132, the temperature of liquid medium of the liquid temperature adjusting device 106 is controlled simultaneously. With such control, it is possible to maintain a constant ink outlet temperature of another heat exchange unit 104.

An example relating to two colors will be explained below.

When there is a difference in temperature between inks of two colors, the liquid medium flow rates $W_1$, $W_2$ are determined by the table in order to obtain a constant ink outlet temperature. Further, temperature efficiencies $\epsilon_1$, $\epsilon_2$ corresponding to the liquid medium flow rates $W_1$, $W_2$, respectively, are found from the formula $\epsilon=\alpha\times W^{1/2}$.

Where the ink outlet temperatures for two colors coincide in Formula (1), the following equation is valid.

$$\epsilon_1\times(\text{Liquid Medium Temperature})+(1-\epsilon_1)\times(\text{Ink Inlet Temperature 1})=\epsilon_2\times(\text{Liquid Medium Temperature})+(1-\epsilon_2)\times(\text{Ink Inlet Temperature 2}) \quad (2)$$

Therefore, the liquid medium temperature is determined from Formula (2).

Liquid supply apparatuses and image forming apparatuses in accordance with the present invention are described in details above, but the present invention is not limited to the above-described examples and it goes without saying that a variety of modifications or changes can be made without departing from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid supply apparatus comprising:

a plurality of heat exchange devices which are respectively provided on a plurality of supply paths for supplying liquids to a plurality of liquid ejection heads respectively, are supplied with a liquid medium adjusted to a predetermined temperature from a liquid temperature adjusting device, and conduct heat exchange between the liquid medium supplied from the liquid temperature adjusting device and the liquids flowing in the plurality of supply paths;

a plurality of flow rate adjusting devices which are respectively provided correspondingly to the plurality of heat exchange devices and adjust a flow rate of the liquid medium supplied to each of the plurality of heat exchange devices from the liquid temperature adjusting device; and a controller which controls each of the plurality of flow rate adjusting devices to individually change the flow rate of the liquid medium supplied from the liquid temperature adjusting device to the plurality of heat exchange devices.

2. The liquid supply apparatus as defined in claim 1, wherein:

the plurality of flow rate adjusting devices are flow rate control valves; and the controller changes opening area of the flow rate control valves to change the flow rate of the liquid medium supplied from the liquid temperature adjusting device to the plurality of heat exchange devices.

3. The liquid supply apparatus as defined in claim 1, wherein:

each of the plurality of flow rate adjusting devices includes a plurality of parallel flow paths in parallel connected in an individual flow path of the liquid medium to the heat exchange device, and a plurality of electromagnetic valves respectively provided in the plurality of parallel flow paths; and the controller controls opening and closing of the plurality of electromagnetic valves to change the flow rate of the liquid medium supplied from the liquid temperature adjusting device to the plurality of heat exchange devices.

4. The liquid supply apparatus as defined in claim 3, wherein part or all of the plurality of parallel flow paths have mutually different flow path resistances.

5. The liquid supply apparatus as defined in claim 3, wherein all of the plurality of parallel flow paths have a same flow path resistance.

6. The liquid supply apparatus as defined in claim 1, further comprising a plurality of liquid temperature measuring devices which measure temperature of the liquids supplied to the plurality of liquid ejection heads respectively, wherein the controller controls each of the plurality of flow rate adjusting devices according to the temperature of the liquids measured by the plurality of liquid temperature measuring devices.

7. The liquid supply apparatus as defined in claim 6, wherein:

the controller is configured to control each of the flow rate adjusting devices to increase the flow rate of the liquid medium supplied to a corresponding one of the heat exchange devices when the temperature of the liquid measured by a corresponding one of the liquid temperature measuring devices is higher than a reference value; and the controller is configured to control each of the flow rate adjusting devices to reduce the flow rate of the liquid medium supplied to a corresponding one of the heat exchange devices when the temperature of the liquid measured by a corresponding one of the liquid temperature measuring devices is lower than the reference value.

8. The liquid supply apparatus as defined in claim 1, further comprising a plurality of liquid flow rate measuring devices which measure flow rates of the liquids supplied to the plurality of liquid ejection heads respectively, wherein the controller controls each of the plurality of flow rate adjusting devices according to the flow rates of the liquids measured by the plurality of liquid flow rate measuring devices.

9. The liquid supply apparatus as defined in claim 8, wherein:

the controller is configured to control each of the flow rate adjusting devices to increase the flow rate of the liquid medium supplied to a corresponding one of the heat exchange devices when the flow rate of the liquid measured by a corresponding one of the liquid flow rate measuring devices is higher than a reference value; and the controller is configured to control each of the flow rate adjusting devices to reduce the flow rate of the liquid medium supplied to a corresponding one of the heat exchange devices when the flow rate of the liquid measured by a corresponding one of the liquid flow rate measuring devices is lower than the reference value.

10. The liquid supply apparatus as defined in claim 1, further comprising a head ejection ratio calculation device which calculates ejection ratios of the plurality of liquid ejection heads, wherein the controller controls the plurality of flow rate adjusting devices according to the ejection ratios of the plurality of liquid ejection heads calculated by the head ejection ratio calculation device.

11. The liquid supply apparatus as defined in claim 10, wherein:

the controller is configured to control each of the flow rate adjusting devices to increase the flow rate of the liquid medium supplied to a corresponding one of the heat exchange devices when the ejection ratio of a corresponding one of the liquid ejection heads calculated by the head ejection ratio calculation device is higher than a reference value; and the controller is configured to control each of the flow rate adjusting devices to reduce the flow rate of the liquid medium supplied to a corresponding one of the heat exchange devices when the ejection ratio of a corresponding one of the liquid ejection heads calculated by the head ejection ratio calculation device is lower than the reference value.

12. The liquid supply apparatus as defined in claim 1, wherein the controller controls each of the plurality of flow rate adjusting devices and also controls temperature of the liquid medium adjusted by the liquid temperature adjusting device.

13. An image forming apparatus comprising the liquid supply apparatus as defined in claim 1.

* * * * *